US010137344B2

(12) United States Patent
Lacey et al.

(10) Patent No.: US 10,137,344 B2
(45) **Date of Patent: *Nov. 27, 2018**

(54) ASYMMETRICAL ICE HOCKEY STICK HANDLE

(71) Applicant: WM. T. BURNETT IP, LLC, Baltimore, MD (US)

(72) Inventors: Sam Lacey, Portland, OR (US); Richard B. C Tucker, Jr., Ruxton, MD (US)

(73) Assignee: Wm. T. Burnett IP, LLC, Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/325,928

(22) PCT Filed: Dec. 3, 2015

(86) PCT No.: PCT/US2015/063745

§ 371 (c)(1),
(2) Date: Jan. 12, 2017

(87) PCT Pub. No.: WO2017/052675

PCT Pub. Date: Mar. 30, 2017

(65) Prior Publication Data

US 2017/0246519 A1 Aug. 31, 2017

Related U.S. Application Data

(60) Provisional application No. 62/221,883, filed on Sep. 22, 2015.

(51) Int. Cl.
*A63B 59/70* (2015.01)
*A63B 60/06* (2015.01)
(Continued)

(52) U.S. Cl.
CPC ..... *A63B 59/70* (2015.10); *A63B 60/10* (2015.10); *A63B 60/12* (2015.10); *A63B 60/06* (2015.10);
(Continued)

(58) Field of Classification Search
CPC ..... A63B 59/70; A63B 2102/24; A63B 60/06
(Continued)

(56) References Cited

U.S. PATENT DOCUMENTS 5,312,100 A * 5/1994 Ilacqua ..... A63B 59/70 473/562
5,577,725 A * 11/1996 Pagotto ..... A63B 59/70 473/560
(Continued)

FOREIGN PATENT DOCUMENTS

| | | | |
|---|---|---|---|
| CA | 2106178 | 3/1995 | |
| CA | 2106178 A1 * | 3/1995 | ..... A63B 59/70 |
| DE | 3842126 | 8/1990 | |

*Primary Examiner* — Mark Graham
(74) *Attorney, Agent, or Firm* — Gordon Feinblatt LLC; Royal W. Craig

(57) ABSTRACT

An embodiment of the invention provides an tee hockey stick handle providing improved grip and tactile feel to a player, and having a cross-section symmetric about one centerline and asymmetric about another orthogonal centerline, a section line parallel and offset from said second centerline dividing said cross-section into a bottom profile comprising an irregular convex polygon with or without rounded and/or beveled edges, and a top rectangular profile with or without rounded and/or beveled edges. The sides of the cross-section, may be linear or slightly concave.

33 Claims, 6 Drawing Sheets

(51) Int. Cl.
*A63B 60/12* (2015.01)
*A63B 60/10* (2015.01)
*A63B 102/24* (2015.01)

(52) U.S. Cl.
CPC ..... *A63B 2102/24* (2015.10); *A63B 2209/02* (2013.01)

(58) Field of Classification Search
USPC ..... 473/560
See application file for complete search history.

(56) References Cited

U.S. PATENT DOCUMENTS

| | | | | |
|---|---|---|---|---|
| 6,267,697 | B1 * | 7/2001 | Sulenta | A63B 59/70 473/560 |
| 8,052,551 | B2 * | 11/2011 | Blotteaux | A63B 49/14 473/513 |
| 9,757,631 | B2 * | 9/2017 | Lacey | A63B 59/70 |
| 2004/0087395 | A1 * | 5/2004 | Manory | A63B 60/06 473/560 |
| 2005/0215364 | A1 * | 9/2005 | Lussier | A63B 59/70 473/560 |
| 2011/0028250 | A1 * | 2/2011 | Pearson | A63B 59/70 473/562 |

* cited by examiner

FIG. 3(A)
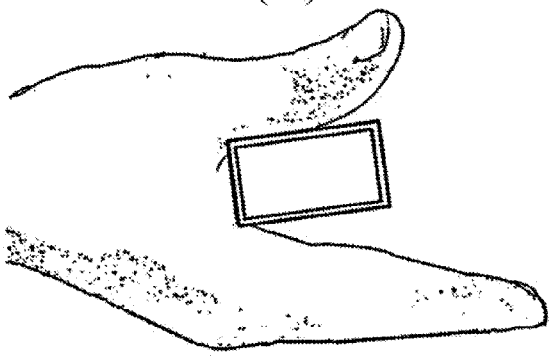
FIG. 3(B)
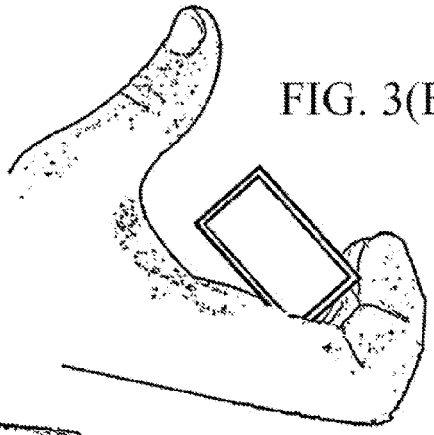
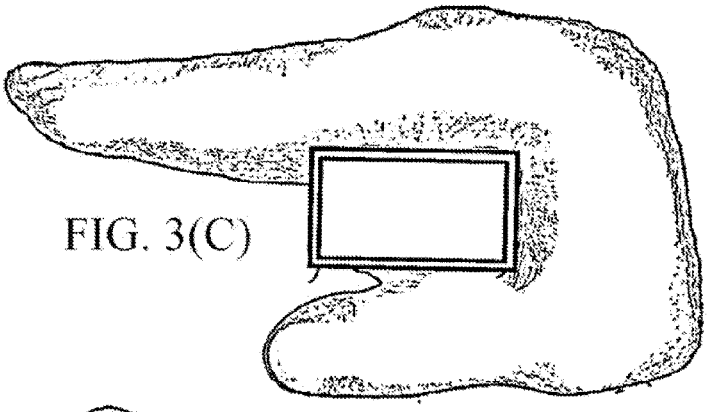
FIG. 3(C)
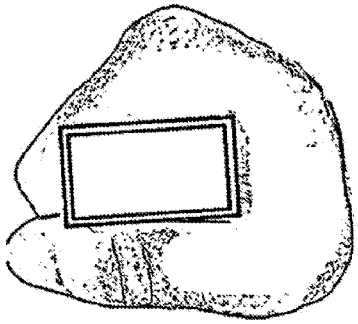
FIG. 3(D)
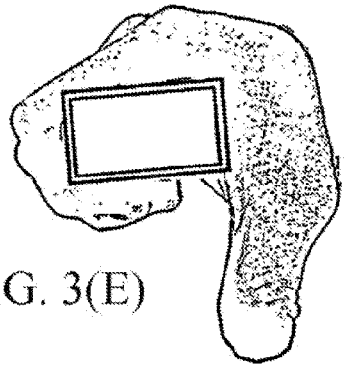
FIG. 3(E)

ASYMMETRICAL ICE HOCKEY STICK HANDLE

CROSS-REFERENCE TO RELATED APPLICATIONS

The present application derives priority from U.S. provisional application Ser. No. 62/221,883 filed Sep. 22, 2015.

BACKGROUND OF THE INVENTION

1. Field of the Invention

The present invention relates generally to ice hockey stick handles (also referred to as shafts), and more particularly, to a hockey stick handle that has an asymmetric cross-section over all or part of its length.

2. Description of the Background

The handling of a hockey stick requires a player to hold and control a hockey stick in numerous specific ways with many different combinations of hand placement over the length of the handle, each optimal for the live action situation confronting the player. Consequently, hockey players constantly move their hands along the handle in multiple positions to grip and control the hockey stick handle. This control is generally referred to as "stick handling." Effective stick handling requires a player to constantly reposition his hands along the handle to control the blade of the hockey stick. As used herein, "stick" refers to the apparatus as a whole, including the handle (or shaft) on which a player's hand(s) is/are placed, and the blade.

On a basic level, certain hand positions are correct and others incorrect. FIG. 1 shows an example. FIG. 1(A) illustrates proper hand placement when skating with one hand on the hockey stick: the other hand is removed from the stick and the active hand is placed atop the stick near the end (as shown) for freedom to skate. FIG. 1(B) shows an unconventional hand placement for a one-handed sick maneuver where the palm is beneath the stick and considerably away from the end of the handle. Hockey sticks typically have a rectangular symmetrical shape such that the top section of the handle is a mirror image of the bottom section of the handle, contributing nothing to a player's tactile feel. In other words, from the feel of the handle alone, a player cannot sense a difference between the top section and the bottom section of an entirely rectangular handle. As a result, it is common to mistake the orientation of the hockey stick, especially during the heat of play with protective ice hockey gloves diminishing a player's tactile feel. FIG. 2 is a cross-section of many prior art hockey stick handles with three sets of exemplary dimensions.

Throughout a hockey game, players must maintain correct hand placement in a wide variety of split-second situations. In each situation, the appropriate hand placement enables the player to impart force and torque on the hockey stick to effect a desired motion, e.g., passing, shooting or maneuvering a hockey puck. FIG. 3 gives several examples of common hand positions on substantially rectangular-shaped handles, including an open hand at FIGS. 3(A-C), a closed hand at FIG. 3(D) and a partially open hand at FIG. 3(E). In competitive situations, the player must quickly change hand placements and grips to react to and outplay his opponent for control of the puck. Thus, between the execution of consecutive skills, a player must release or slide one of his hands, move it to a new position, and re-grip the handle with a strong hold.

An example of this constant hand repositioning is a hockey player who intercepts a puck, carries the puck while charging to goal, and then shoots the puck. In carrying the puck the player typically grabs the hockey stick handle at or near its distal end with one hand for maximum reach, and extends the hockey stick out in front while skating. Once the puck is under control the player pulls the hockey stick toward his body and simultaneously repositions one or both hands, often grabbing the handle with both hands spread along the shaft, and maintains this grip while skating and carrying the puck. Then, when preparing to shoot, the player re-grips the bottom end of the handle and cocks the stick back with both hands. Thus, in the course of executing three consecutive game skills, the player quickly repositions his hands multiple times.

The ability to properly position and quickly reposition hand placement without losing control of the handle requires a player to make subtle adjustments in hand gripping force. A strong gripping force is required to hold and cock the stick, especially for the lower hand. An intermediate gripping force is required to slide a hand along the shaft without releasing the handle entirely. Such rapid grip adjustments are sometimes difficult to execute on conventional handles, which typically have a rectangular, symmetrical shape such that the top section of the handle is a mirror image of the bottom section of the handle. Such geometry, particularly on the bottom section of a handle where a player's fingers wrap around and connect to the handle does not cooperate with a player's hand naturally and provides little or no tactile feedback. In addition, factoring in the effects of fatigue, perspiration and bulky protective gloves, it is easy to see why players sometimes lose a firm grip on ice hockey stick handles and desire more tactile feedback.

The use of hockey protective gloves can frustrate a player's grip on the hockey stick shaft. Although these gloves protect the outside of a player's hand, the layer of material between the shaft and the player's palm and fingers, no matter how tacky, reduces the player's tactile feel for the shaft. To improve grip, players frequently tape the shafts with athletic tape, Tourna Grip™, or similar grip materials. Although these minor adjustments may approximate a grip, it is difficult to build shapes out of the tape that complement finger placement and/or that increase the diameter of the handle to aid a player in using the required gripping force. Athletic tape, the most common add-on by players, has a limited life span before it disassembles and new tape is required. What is needed then is a hockey stick handle having a cross-section that is instantly recognizable by tactile feel through a glove, yet maintains a familiar looking top side geometry, but is more suitable to a hockey player's special demands for stick/puck handling, passing and shooting at high speed and pinpoint accuracy. The cross-section of the disclosure can accommodate hockey-specific hand movements in terms of how and where a player grips the handle, slides and then repositions his hands and executes passing and shooting mechanics, while providing useful tactile feedback. For experienced players that demand a traditional hockey stick visual, the cross-section of the disclosure also satisfies that need. In addition, the cross-section of the disclosure reduces the shaft weight without compromising strength, rigidity, and durability at particular locations along the handle.

SUMMARY OF THE INVENTION

One aspect of the present invention provides a hockey stick handle having an asymmetric non-rectangular cross-section along all or part of the handle length to provide informative tactile feedback.

In an embodiment, the asymmetric non-rectangular cross-section runs all of the handle length, needing only to change along its length to transition to and interface with the blade portion of the stick, as is understood in the art. In another embodiment, the asymmetric non-rectangular cross-section runs along a "middle portion" of the handle, e.g., a medial segment of the handle comprising at least 30% of the entire length of the handle located where the player frequently grips with their bottom hand. As such, this middle portion asymmetry ensures tactile feedback to the user. In this embodiment the asymmetric cross-section may transition near the distal section (upper tip) of the handle to a symmetric rectangular cross-section to give both right-handed and left-handed players the same feel when grasping the handle.

In yet another embodiment, the asymmetric cross-section runs along a segment of the handle length that includes the middle portion of the handle but not either the distal or proximate sections of the handle.

For purposes of the disclosure, "asymmetric" is herein defined as lacking the mirror-image or near mirror image quality of symmetry along the top and bottom of a handle, and "symmetric" is the opposite. The "bottom section" of the handle will refer to that portion of the handle when viewed from a cross-section that comprises a non-rectangular polygonal shape, and the "top section" of a handle refers to that portion of the handle when viewed from the same cross-section that comprises a generally rectangular shape. When viewing the handle in an xyz coordinate system with the elongate handle running up the y-axis the handle will have an overall length along the y-axis. At any point along the y-axis the handle will have an overall cross-section parallel to the x-z plane. Viewing a cross-section at any point along the y-axis, a theoretical "section line" parallel to the z-axis bisects the cross-section into two sections and separates the "top section" from the "bottom section." The section line will be slightly offset from the y-axis along the x-axis. This theoretical section line defines and is included as one side of both the "top section" and the "bottom section" for purposes of any geometric description herein.

One skilled in the art will understand that many hockey sticks utilize a replaceable blade and shaft configuration incorporating a "tenon", "shank" or "hosel", which generally comprises a short keyed extension for insertion into a socket of the blade. However, there are also two-piece hockey sticks in which the blade is formed with an upwardly-protruding keyed extension that inserts into the hollow handle. In either case, the hosel is ignored for purposes of any geometric description of the handle in this disclosure.

In all embodiments of the disclosure, the asymmetric section can have a unique non-rectangular polygonal cross-section (e.g. hexagonal, polygonal, isosceles trapezoidal), asymmetric about the section line (parallel to the z-axis), which causes the entire cross section of the handle to form an irregular convex shape. The asymmetrical cross section remains constant over all or most of the handle's length, only deviating in some embodiments to accommodate intersection with the blade portion of the stick. In an embodiment wherein the ice hockey stick is either one-piece or two-piece but the blade portion has a receptacle designed to match the handle or vice versa, the asymmetric cross section remains constant over the entire length of the handle and inserts into the receptacle. In another embodiment, wherein the stick is two-piece and the blade portion receptacle does not match the handle, the handle cross section for visual and fit purposes transitions from the asymmetric cross section to a symmetric or other geometry (e.g., spear-like or other design choice shape) that fits the blade portion receptacle.

The asymmetric cross-section can comprise on its bottom section at least two beveled or rounded edges diverging from a short bottom edge, the angles being tailored for the requirements and preferences of a hockey player, as disclosed below.

The asymmetric convex cross-section may be symmetric along the vertical centerline (x-axis), asymmetric along the horizontal section line, and defined by three substantially orthogonal long sides joined by three angled short sides. One of the short sides is parallel to a long side on the top portion and the other two short sides join the other two long sides at an angle, such that two short sides form beveled edges. All edges can be rounded, and all sides may optionally be slightly concave.

The cross-sectional shape, length, and location of the handle sides accommodate the gripping, sliding, and carrying techniques peculiar to hockey. In addition, the asymmetric convex cross-sections of the disclosure can provide desired degrees of strength, rigidity, and durability at particular locations along the handle.

To achieve the asymmetric cross-section, the preferred manufacturing process is high pressure bladder molding that is understood in the art. In a preferred one cross sectional handle, however, conventional techniques such as extrusion and post-extrusion bending can be utilized.

The present invention is described in greater detail in the detailed description of the invention, and the appended drawings. Additional features and advantages of the invention will be set forth in the description that follows, will be apparent from the description, or may be learned by practicing the invention.

BRIEF DESCRIPTION OF THE DRAWINGS

Other objects, features, and advantages of the present invention will become more apparent from the following detailed description of the preferred embodiments and certain modifications thereof when taken together with the accompanying drawings in which:

FIG. 3 gives several examples of common hand positions

DETAILED DESCRIPTION OF THE PREFERRED EMBODIMENTS

Reference will now be made in detail to preferred embodiments of the present invention, examples of which are illustrated in the accompanying drawings. Wherever possible, the same reference numbers will be used throughout the drawings to refer to the same or like parts.

Figure 1A:
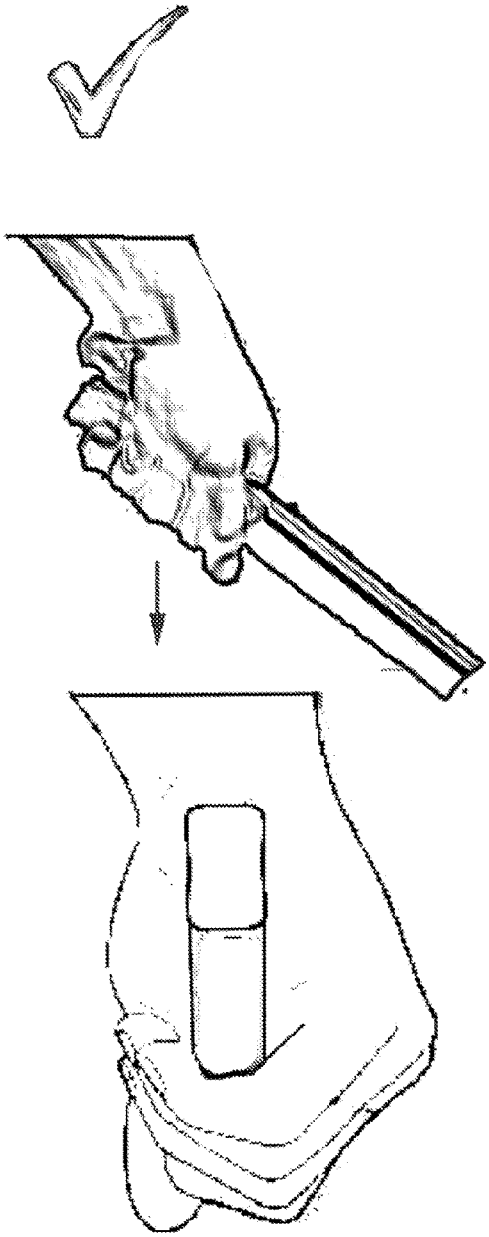
FIG. 1 illustrates an example of a correct hand position (A-B) and unconventional position (C)
Figure 1B:
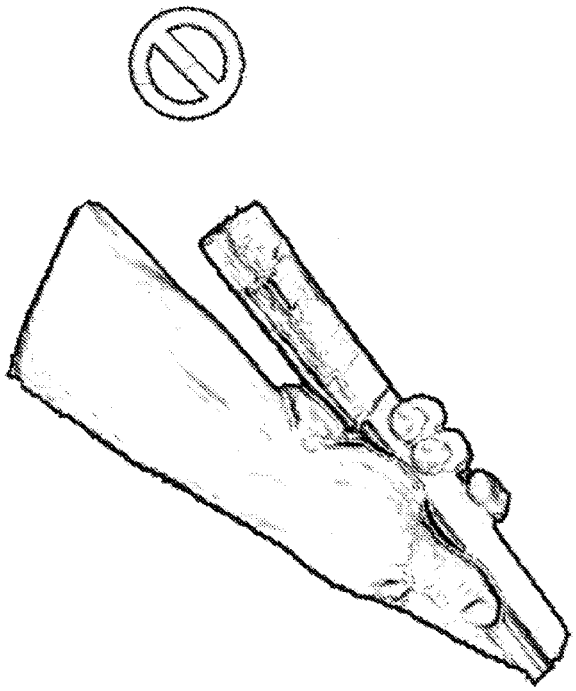
Figure 2:
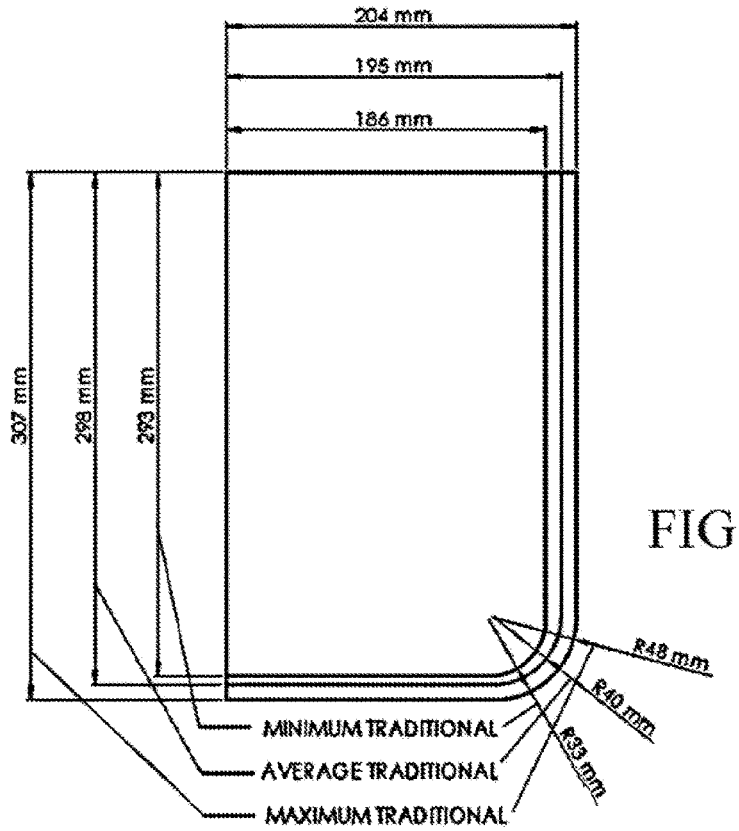
FIG. 2 is a cross-section of prior art hockey stick handles with three sets of exemplary dimensions.
Figure 4:
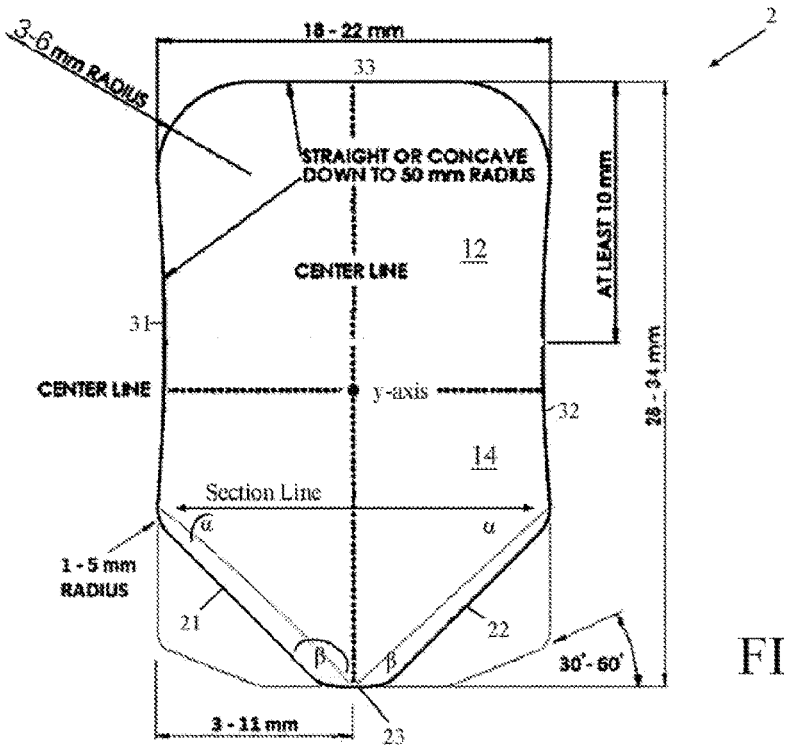
FIG. 4 is a cross-section of an ice hockey stick handle with exemplary dimensions according to an embodiment of the present invention.

FIG. 4 illustrates an improved cross-section of the ice hockey stick handle 2 with exemplary dimensions according to an embodiment of the present invention. The hockey stick handle 2 is formed with an overall-asymmetrical cross-section that, in its entirety, can be in the form of an irregular convex hexagon, formed by adding radius or beveling the edges in its bottom section. The asymmetrical cross-section accommodates particular hand movements unique to hockey stick handling, such as sliding a hand along the length of the handle or gripping a handle to whip the hockey stick along its longitudinal axis or to resist torque applied to the hockey stick around its longitudinal axis. The cross-sectional shape provides the handle with structural and tactile features that correspond to the way in which a player moves his hands along the handle and grips the handle.

The asymmetrical cross section remains constant over all or part of the handle's length, deviating in one embodiment only when necessary to accommodate intersection with the blade portion of the stick. In other embodiments the asymmetric cross-section may extend along at least 30% of the entire length of the handle or along only a segment of the handle that includes the middle portion of the handle. In one embodiment wherein the ice hockey stick is either one-piece, or two-piece but the blade portion has a receptacle designed to match the handle or vice versa, the asymmetric cross section remains constant over the entire length of the handle for insertion into the receptacle. In another embodiment, wherein the stick is two-piece and the blade portion receptacle does not match the handle, the handle cross section for visual and fit purposes transitions from the asymmetric cross section to a geometry that fits the blade portion receptacle, e.g., spear-like or other shape as a matter of design choice.

As seen in FIG. 4, the asymmetric cross-section may be symmetric along one theoretical centerline running top-to-bottom, and asymmetric along the other theoretical centerline running side-to-side. The horizontal centerline may bisect the cross-section into two sections of equal enclosed area. A theoretical horizontal section line subdivides the cross-section into the top section 12 above the section line and the bottom section 14 below, in both instances taking the horizontal section line as forming a side for purposes of geometric description.

The substantially rectangular top section 12 affords both left handed and right handed players the same look and feel when grabbing the handle. Top section 12 can be defined by four substantially orthogonal sides 31-33 (the fourth side defined by the section line). Two long sides 31, 32 are of uniform length, are joined together at both ends by the section line side and short side 33, respectively. The short side 33 is parallel to the opposing section line side. In a preferred embodiment the two long sides 31, 32 are within a range of from 21-31 mm long and of uniform length, and the short side 33 is within a range of from 18-22 mm long. Both corner-edges are preferably rounded at radius within a range of from 3-6 mm.

The irregular convex bottom section 14 can be defined by three long sides 21, 22, and the section line and a short side 23. Two long sides 21, 22 are of uniform length, are joined together at one end by the section lineside, and are joined together at their other end by the short side 23. The short side 23 is parallel to the opposing long section line side. The other two long sides 21, 22 join the long section line side at an acute angle $\alpha$ within a range of from 15°-75° relative to the horizontal section line side, more preferably 30°-60° (as shown). The two flanking long sides 21, 22 join the short side 23 at an obtuse interior angle $\beta$, supplementary to acute angle $\alpha$. All corner-edges are preferably rounded or beveled. In a preferred embodiment the two angled long sides 21, 22 are within a range of from 5-27 mm long and of uniform length, and the section line side is within a range of from 18-22 mm long. The two right-angle edges formed thereby are rounded at radius within a range of from 3-6 mm, most preferably at a 4.5 mm radius of curvature and are made slightly bulbous. Any or all of the long sides 21, 22 may be straight or slightly concave, and if the latter, the concavity should not be less than a 70 mm radius of curvature. The short side 23 is within a range of from 1-13 mm long, and its edges are rounded or beveled in the previously specified angle range, preferably within a distance range of from 3-11 mm from the edge. The four opposing edges of bottom section 14 are rounded at a smaller radius of curvature within a range of from 1-4 mm, and most preferably 2 mm. Again, FIG. 4 provides an exemplary set of dimensions contemplated by the disclosure, and all angular/dimensional ranges stated herein are specific to the ice hockey handle of the invention. The two rounded or beveled edges at short side 23 are preferably angled within a range of from 30-60 degrees relative to a horizontal section line. The foregoing construct provides a substantially rectangular top mass above both the horizontal centerline and the horizontal section line, a hexagonal bottom mass below the centerline, and a trapezoidal bottom mass below the horizontal section line. One skilled in the art will readily understand that the above-described asymmetric cross-section need not run the entire length of the handle, but rather may run along most of the handle length or only along one or more sections of the handle length at least including a middle portion of the handle. Also, in many cases a hockey stick handle may be constructed with design elements and/or surface patterns to increase grip.

Figure 5:
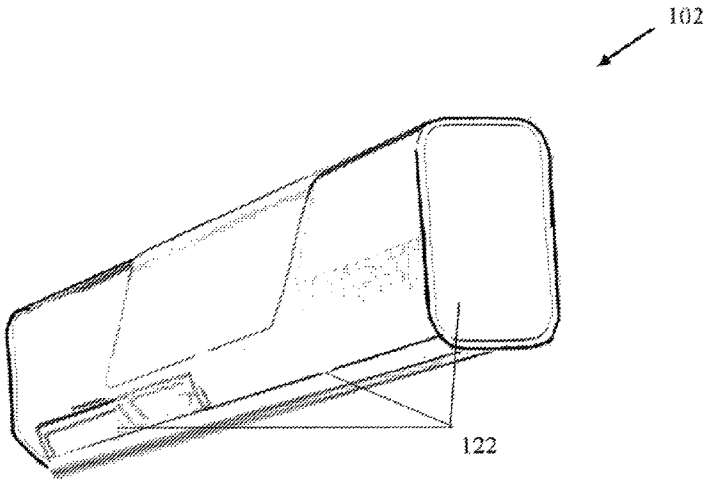
FIG. 5 is a side-perspective illustration of an embodiment wherein the asymmetrical cross-section 14 extends along a middle section of the handle length.

For example, FIG. 5 is a side-perspective illustration of an alternate embodiment 102 wherein a lower section of the handle (not shown) proximate the blade has a traditional rectangular cross-section, an upper section 122 of the handle 102 transitions from an overall-symmetrical cross-section in the form of a traditional substantially rectangular cross-section 122 with radiussed or beveled edges at the distal end, to an improved cross-section 124 according to an embodiment of the present invention. The improved cross-section 124 extends at least along the middle portion of the handle where the player frequently grips with their bottom hand.

Figure 6:
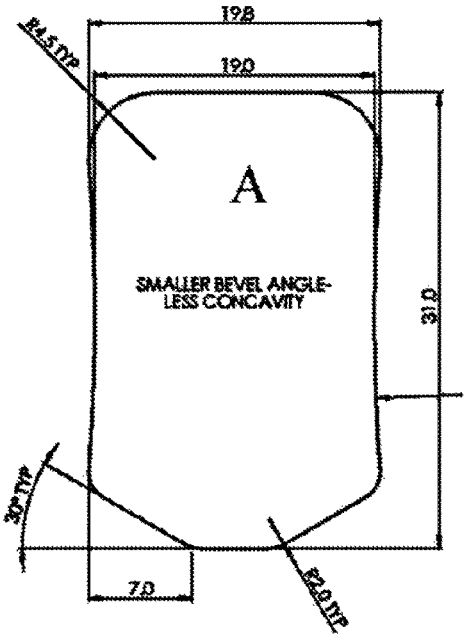
FIG. 6 illustrates an alternative set of dimensions for the asymmetrical convex cross-section of the handle with a smaller bevel angle (30 degrees) and less concavity.

FIG. 6 illustrates an alternative set of dimensions for the asymmetric convex cross-section of the handle with a smaller bevel angle (30 degrees) and less concavity.

Figure 7:
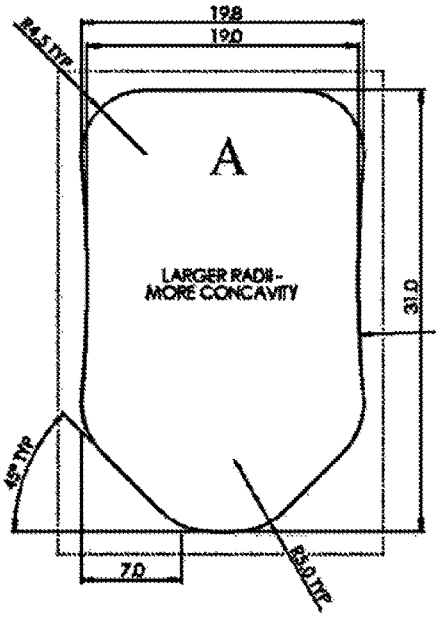
FIG. 7 illustrates another alternative set of dimensions for the asymmetric convex cross-section with a larger bevel angle (45 degrees) and more concavity.

FIG. 7 illustrates another alternative set of dimensions for the asymmetric convex cross-section with a larger bevel angle (45 degrees) and more concavity.

Figure 8:
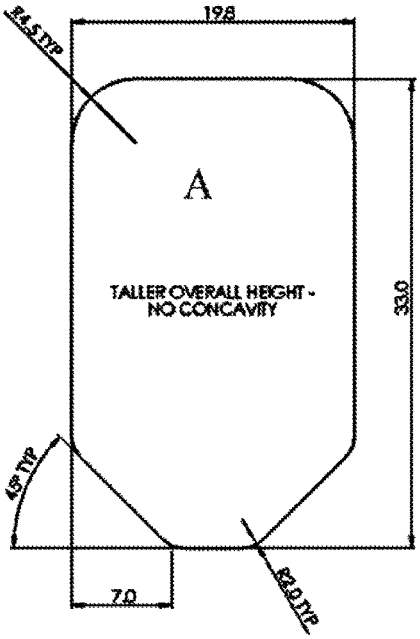
FIG. 8 illustrates yet another alternative set of dimensions for the asymmetric convex cross-section with a taller overall height and no concavity.

FIG. 8 illustrates yet another alternative set of dimensions for the asymmetric convex cross-section with a taller overall height and no concavity.

Figure 9:
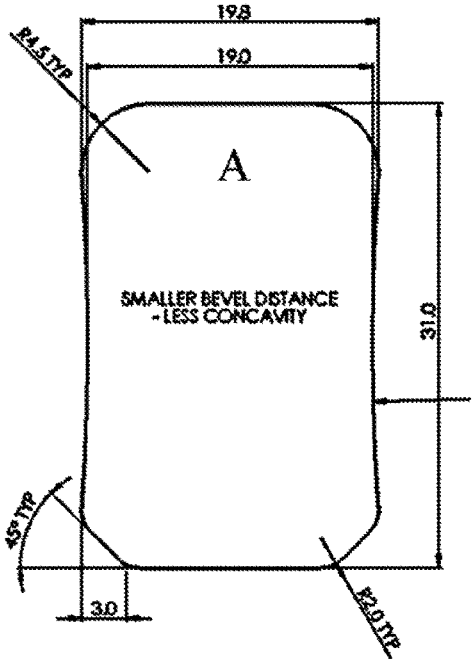
FIG. 9 illustrates still another alternative set of dimensions for the asymmetric convex cross-section with a smaller bevel distance and less concavity.
Figure 11A:
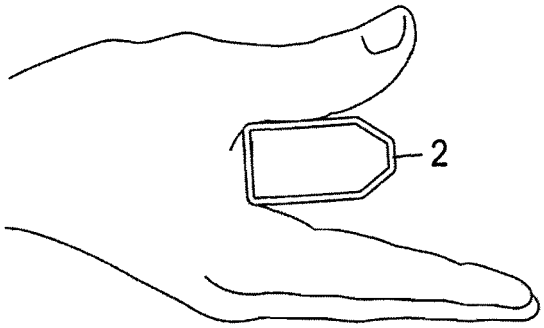
FIG. 11 gives several examples of common hand positions on the handle 2 of the present invention.
Figure 11B:
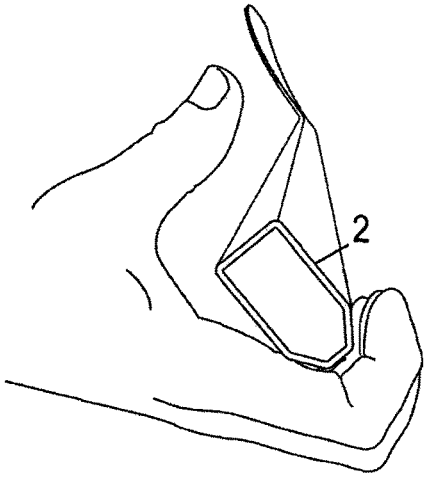
Figure 11C:
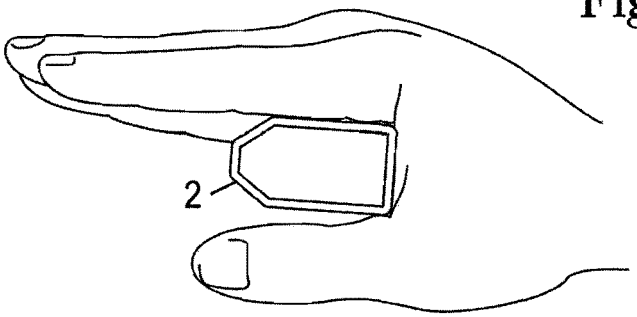
Figure 11D:
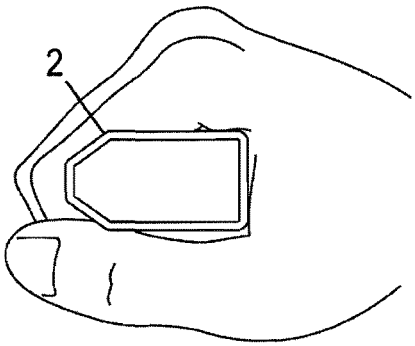
Figure 11E:
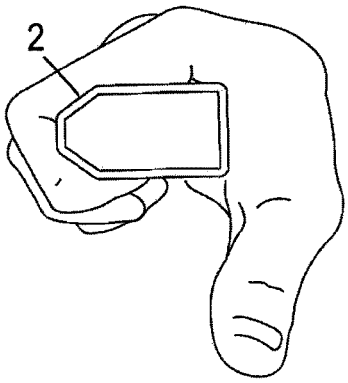

FIG. 9 illustrates still another alternative set of dimensions for the asymmetric convex cross-section with a smaller bevel distance and less concavity.

Figure 10:
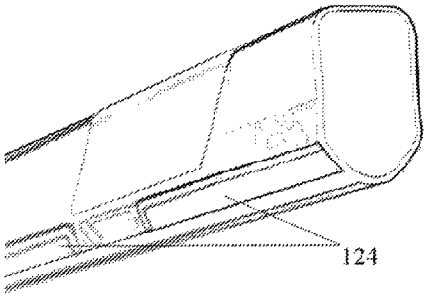
FIG. 10 illustrates a top-to-bottom warp along the top section 12 in accordance with an embodiment of the invention.
Figure 10:
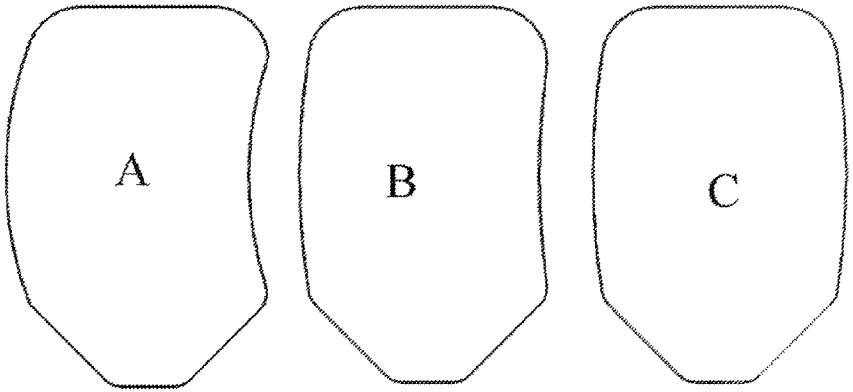

In addition to the foregoing dimensional variables, varying degrees of convexity or concavity are contemplated along the cross-section centerline running top-to-bottom, creating what could be described as a warped or bulged profile. This top-to-bottom warp or bulge may be desirable to some players, for example, to conform the handle to the curve of their dominant hand. As seen in FIG. 10, the warp is imposed on the top section 12 and curves the two opposing long sides 31, 32 between the horizontal section line and short side 33, respectively, rendering one long side convex and one concave. In this embodiment, the handle cross-section symmetry along the vertical centerline is disturbed. The warp of the handle 2 may be achieved by a constant radius of curvature along long sides 31, 32, which may be more or less as a matter of design choice within a range of from 25 mm to infinity (flat), more preferably within a range of from 10 mm-100 mm, and most preferably within a range of from 30 mm-60 mm. To illustrate, the more warped shaft profile of FIG. 10(A) has a radius of curvature of 30 mm, while the less curved profile of FIG. 10(B) has a radius of 60 mm. The two profiles illustrated in FIGS. 10(A-B) employ the same radius of curvature along both long sides 31, 32, but different radii are possible as well. The convex long side may have a greater or lesser radius of curvature than the concave long side. The profile illustrated in FIG. 10(C) employs an inverse radius of curvature along both long sides 31, 32, resulting in two convex long sides 31, 32.

In all above-described embodiments the cross-sectional shape, length, and location of the asymmetric handle accommodate the gripping, sliding, and carrying techniques unique to hockey, providing tactile feedback to inform the player of hand placement and/or an alternative stick shape option. This is immediately apparent during use, and most readily apparent from a visual collage. FIG. 11 gives several examples of common hand positions on the handle 2 of the present invention. Beginning with the open position at FIG. 11(A), the hand only encounters the traditional symmetric section of the hockey handle, and the tactile feedback is identical regardless of the handedness of the player. At FIG. 11(B), the player is rolling the stick to angle the blade properly to, for example, stop a puck coming at an angle, and the angle of the blade can be more precisely determined based on tactile feedback from the angle of the asymmetric section against the forefingers of the hand. Similarly in the partially open position at FIG. 11(C), the player can more precisely angle the blade straight outward based on four to five angled sides, versus only three angled sides in a traditional rectangular handle. The pads at the base of the fingers maintain contact with the asymmetric section sides to provide additional tactile feedback. This same advantage applies to the closed and partially closed hand positions of FIGS. 11(D-E) as well.

A preferred manufacturing process entails high pressure bladder molding carbon-based composite handles within an appropriately shaped mold, although conventional techniques such as extrusion and post-extrusion bending are also possible methods to manufacture. In comparison to handles having traditional cross-sections that are symmetrical in terms of their top and bottom sections, the embodiments of FIGS. 2-6 provide an alternative improved shape. With traditional rectangular handles or non-rectangular but symmetrical cross sectional handles, when a player's hand positioned closer to the blade is in a puck-carrying or shooting position, the player experiences no difference in feel from that of his other hand positioned closer to the handle, and the player gains no tactile feedback to assist with basic hockey maneuvers. The hexagonal bottom section handle 2 embodiment within the dimensions of the disclosure avoids this feedback problem by changing the player's hand sensations, without too drastically changing the traditional feel, look and overall play of a hockey stick.

According to another embodiment of the present invention, the above-described hockey handles are formed by high pressure bladder molding of carbon-based composite material on a pneumatically-inflated bladder to press composite working material into a die. The basic steps of high-pressure bladder molding comprise: 1) creating a composite preform of the handle; 2) inserting an inflatable bladder; 3) placing the composite preform into a preset mold (mold usually aluminum or steel); 4) pre-heating the mold; 5) pneumatically inflating the bladder to exert high pressure from the inside; and 6) curing. During curing, the composite hardens and holds the shape of the mold.

Any polymer-based composite material may be used, including fiberglass, carbon fiber, or Kevlar™, for example. The composite material is formed in a preform structure approximating the negative mold cavity, e.g., a hollow composite tube shaped lengthwise to fit the negative mold that has the shape of the desired hockey handle.

The embodiments of the present invention described above apply equally well to men's hockey sticks, to women's hockey sticks, to sticks for players of all sizes and ages, to sticks used in competition hockey (e.g., professional, club, and box hockey, and hockey governed in whole or in part by NCAA rules), and to sticks used in non-competition hockey (e.g., recreational and instructional hockey sticks used in physical education classes). In each application, the present invention is adaptable to provide unique advantages for different types of players at different levels of play.

Other embodiments of the invention will be apparent to those skilled in the art from consideration of the specification and practice of the invention disclosed herein. It is intended that the specification and examples be considered as exemplary only, with a true scope and spirit of the invention being indicated by the claims. In addition, as one of ordinary skill in the art would appreciate, any dimensions shown in the drawings or described in the specification are merely exemplary, and can vary depending on the desired application of the invention. Many variations and modifications of the embodiments described herein will be obvious to one of ordinary skill in the art in light of the above disclosure. The scope of the invention is to be defined only by the claims, and by their equivalents.

STATEMENT OF INDUSTRIAL APPLICABILITY

In ice hockey, the ability to properly position and quickly reposition hand placement without losing control of the handle requires a player to make subtle adjustments in hand gripping force. Such rapid grip adjustments are sometimes difficult to execute on conventional rectangular handles, which provide no informative tactile feedback. This is a problem, especially when using hockey gloves. There would be great industrial applicability in an ice hockey stick handle having a cross-section that is instantly recognizable by tactile feel through a glove, without deviating too far from the conventional handle construction and appearance. The present hockey stick handle with asymmetric non-rectangular cross-section extends along all or part of the handle length provides informative tactile feedback and fulfills that need.

We claim:

1. An ice hockey stick including a blade attached to a handle, the handle providing improved grip and tactile feel to a player, said handle extending along a longitudinal axis and said blade extending at an angle therefrom in a first direction, the handle comprising a hexagonal cross-section uniformly defining said handle along all or part of its length, said hexagonal cross-section further comprising an irregular hexagon symmetric about a theoretical first centerline and asymmetric about a theoretical second centerline orthogonal to said first centerline, said irregular hexagon having a first pair of opposing sides including a front side and a back side shorter than said front side and parallel thereto and to said second centerline, and two long sides and two concave sides between each of said front side and back side, wherein said two concave sides converge toward said back side, and said two converging concave sides join said back side at obtuse angles.

2. The hockey stick of claim 1, wherein said hexagonal cross-section remains constant along at least one-half of said handle lengthwise.

3. The hockey stick of claim 1, wherein said hexagonal cross-section has a warped profile about said first centerline.

4. The hockey stick of claim 3, wherein said warp occurs along said first centerline.

5. The hockey stick of claim 4, wherein intersections of all six sides of said hexagonal cross-section are beveled to form beveled edges along said handle.

6. The hockey stick of claim 4, wherein intersections of all six sides of said hexagonal cross-section are rounded to form rounded edges along said handle.

7. The hockey stick of claim 1, wherein said back side and two converging concave sides joined to said back side are all shorter than said two lone sides.

8. The hockey stick of claim 1, wherein said non-rectangular cross-section remains constant along at least one-half of said handle lengthwise, inclusive of a handle portion configured to fit into a socket of a blade.

9. The hockey stick of claim 1, wherein said two long sides are on opposing sides of said first centerline and are each between 21-31 mm in in length, and said front side joins said two lone sides and is orthogonal thereto, said two converging sides each intersecting one of said two long sides and said back side at obtuse angles.

10. The hockey stick of claim 9, wherein said two converging sides both intersect one of said two long sides at a bevel having a radius of between 3-6 mm.

11. A hockey stick tiding a blade attached to a handle, said handle extending along a longitudinal axis and said blade extending at an angle therefrom in a first direction, the handle comprising a hexagonal cross-section uniformly defining a majority of said handle lengthwise, said handle further comprising a first side disposed opposite said first direction a second side disposed opposite said first side, two long sides and two concave short sides between each of said two long sides and said first side, wherein said first side is shorter than said second side.

12. The hockey stick of claim 11, wherein said two long sides are warped.

13. The hockey stick of claim 11, wherein said two concave short sides are radiussed within a range of from 7 mm to 150 mm.

14. The hockey stick of claim 11, wherein intersections of said second side with said two long sides are beveled to form beveled edges along said handle.

15. The hockey stick of claim 11, wherein intersections of said second side with said two long sides are rounded to form rounded edges along said handle.

16. The hockey stick of claim 11, wherein said first side is shorter than said two concave short sides.

17. The hockey stick of claim 14, wherein two long sides are both disposed at right angles to said second side.

18. The hockey stick of claim 15, wherein intersections of said first side with both its two longer sides are beveled to form beveled edges along said handle.

19. The hockey stick of claim 15, wherein intersections of said two concave short sides with said two longer sides are rounded to form rounded edges along said handle.

20. An ice hockey stick comprising a handle for providing improved grip, and a blade attached to said handle, said handle extending along a longitudinal axis and said blade extending at an angle therefrom in a first direction, the handle thither comprising a hexagonal cross-section uniformly defining said handle along all or part of its length, said hexagonal cross-section being symmetric about a theoretical first centerline perpendicular to said longitudinal axis and asymmetric about a theoretical second centerline orthogonal to said first centerline, and said hexagonal cross-section having a first side disposed opposite said first direction, a second side opposite said first side, two long sides between said first side and said second side, and two concave short sides each radiussed within a range of from 7 mm to 150 mm between each of said two long sides and said first side.

21. The hockey stick handle of claim 20, wherein said non-rectangular cross-section remains constant along at least thirty percent of said handle lengthwise.

22. The hockey stick handle of claim 20, wherein said non-rectangular cross-section includes a top section and a bottom section separated by a theoretical section line parallel to said second centerline.

23. The hockey stick handle of claim 22, wherein said top section has a substantially rectangular profile.

24. The hockey stick handle of claim 22, wherein said top section has a warped rectangular profile that disrupts said handle cross-section symmetry about said theoretical first centerline.

25. The hockey stick handle of claim 22, wherein said bottom section profile comprises a short side parallel to said section line and two longer sides disposed at obtuse angles toward said concave short sides.

26. The hockey stick handle of claim 25, wherein intersections of said bottom section concave short sides with both its two longer sides are beveled to form beveled edges along said handle.

27. The hockey stick handle of claim 25, wherein intersections of said bottom section concave short sides with both its two longer sides are rounded to form rounded edges along said handle.

28. The hockey stick handle of claim 25, wherein said top section profile comprises a short side parallel to said section line and two longer sides disposed at right angles to said short side.

29. The hockey stick handle of claim 25, wherein said top section profile comprises a short side parallel to said section line, a convex longer side, and a concave longer side.

30. The hockey stick handle of claim 29, wherein said convex longer side and concave longer side have an equal radius of curvature.

31. The hockey stick handle of claim 29, wherein said convex longer side and concave longer side have a different radius of curvature.

32. The hockey stick handle of claim 25, wherein said top section profile comprises a short side parallel to said section line, and two convex longer sides.

33. The ice hockey stick of claim 20, wherein said non-rectangular cross-section remains constant along at least one-half of said handle lengthwise, inclusive of a handle portion configured to fit into a socket of a blade.

* * * * *